United States Patent [19]

Cornelissens et al.

[11] 4,397,391

[45] Aug. 9, 1983

[54] FEED UNIT FOR A DETERGENT AND PACKAGING THEREOF

[75] Inventors: Emery G. P. Cornelissens, Nootdorp; Gerardus J. W. H. Gudden, Arnhem, both of Netherlands

[73] Assignee: Akzo nv, Arnhem, Netherlands

[21] Appl. No.: 257,607

[22] Filed: Apr. 27, 1981

[30] Foreign Application Priority Data

May 1, 1980 [NL] Netherlands ..... 8002520

[51] Int. Cl.[3] ..... B65D 77/00

[52] U.S. Cl. ..... 206/526; 206/5; 229/65

[58] Field of Search ..... 229/65; 206/5, 526, 206/280, 287, 216, 449, 528

[56] References Cited

U.S. PATENT DOCUMENTS

| | | | |
|---|---|---|---|
| 2,447,754 | 8/1948 | Hirschhorn | 229/65 |
| 2,460,963 | 2/1949 | Young | 229/65 |
| 3,680,771 | 8/1972 | Blunsdon | 229/65 |
| 4,009,287 | 2/1977 | Clarke | 229/65 |

*Primary Examiner*—Joseph Man-Fu Moy

*Attorney, Agent, or Firm*—Stevens, Davis, Miller & Mosher

[57] ABSTRACT

The invention relates to an imposed means of ensuring that the sealing edge(s) of a flat, for instance rectangular, detergent-containing sachets is (are) kept closed. The sealing edge is of the type which is sealed with such a glue that it opens in the water of the washing machine at a temperature above room temperature. The improved means consists in that said sealing edges of the sachets may be bent as they are packaged in a box, as a result of which premature opening of the sachets is prevented during transport or after they have been introduced into the washing machine.

5 Claims, 3 Drawing Figures

FEED UNIT FOR A DETERGENT AND PACKAGING THEREOF

The invention relates to a detergent feed unit comprising one or more compartments having at least one sealing edge provided with a glue or some other adhesive, which sealing edge opens upon contact with water in a washing machine, and which feed unit may optionally contain other ingredients to be used during washing.

The invention also comprises a container for packaging a number of such feed units.

A feed unit of the type indicated above is known from NL 7805293. It describes a feed unit comprising two compartments. In that case the feed unit is in the form of a more or less flat sachet having a rectangular shape.

The one compartment is filled with acid and has a water-permeable outer wall. The other compartment contains an alkaline detergent based on alkali metal carbonate.

The two compartments are separated by an impermeable partition. The edges along the outer wall of the acid-containing compartment are permanently sealed, as far as necessary by means of heat or pressure. Of the outer wall of the alkaline detergent-containing department two parallel edges, referred to hereinafter as sealing edges, are not permanently sealed.

The non-permanently sealed edges are sealed by means of a special adhesive applied internally, i.e. between the edge of the outer wall and the edge of the partition. The special adhesive is temperature sensitive such that the sealing edges of this compartment are opened in a temperature range above room temperature, preferably of from 30° to 60° C. Contained in a working washing machine, such an embodiment of the sachet described in NL 7805293 will first of all release the acid through the water-permeable outer wall of the one compartment. Upon the washing water reaching the temperature range in which the glue on the inside of the sealing edges will soften, the other compartment will open, because the sealing edges are no longer kept closed then by the special adhesive. As the sealing edges open, the alkaline detergent gets into the washing water. Although this known sachet is quite satisfactory, it has yet been found that during transport and storage of the sachets there may be problems in that the sealing edges of the edges may open prematurely.

The invention has for its object to provide a feed unit of the type indicated above which no longer presents the afore-mentioned problems. The detergent feed unit comprising one or more compartments having at least one sealing edge, provided with a glue or some other adhesive, which sealing edge opens upon contact with water in a washing machine is characterized according to the invention in that external means are provided for ensuring that the sealing edges are kept closed. A particularly simple embodiment is characterized according to the invention in that the external means are formed by one or more folds along which the sealing edge is bent through an angle of at least 30° and for instance about 90°-180°.

An effective embodiment of the feed unit is characterized according to the invention in that means are provided for keeping the sealing edge in the folded or bent state. The sealing edge according to the invention can be kept in the folded state in a simple manner by fastening it in one or more places. Such fastenings must be removed shortly before the feed unit is introduced into the washing machine. Another embodiment of the feed unit according to the invention is characterized in that the feed unit is provided with a holder in which the sealing edge is kept in the folded state, which can be realized in a simple manner by means of a clamping element in which the sealing edge is kept in the folded state. Viewed in cross-section and transverse to the longitudinal direction of the sealing seam, said holder or clamping element may be U-shaped and for instance be made of some elastic plastic material or some metal. According to the invention it is also possible for the sachet to be provided with one or more elastic tapes by which the sealing edge is kept in the folded state. Naturally, said holders, clamping elements or elastic tapes must be removed from the sachet before it is introduced into the washing machine.

Favourable results may be obtained with a detergent feed unit which is characterized according to the invention in that the feed unit is of the type whose sealing edge is sealed with such a temperature sensitive glue or some other adhesive that the respective compartment opens at a temperature above room temperature, preferably in the range of 30° to 60° C.

A preferred embodiment according to the invention is characterized in that the feed unit is of the type formed by a, for instance, substantially rectangular sachet comprising at least two compartments, the one compartment having a water-permeable, water-soluble or water-dispersible outer wall and containing an acid and the other compartment containing an alkaline detergent based on alkali metal carbonate, and at least one edge of the compartment containing an alkaline detergent forms said sealing edge and is sealed with a glue or some other adhesive which is so temperature sensitive that this compartment opens in a temperature range above room temperature, preferably in a range of from 30° to 60° C.

The invention also comprises a fed unit consisting of a detergent contained in a sachet, which is characterized in that the sachet comprises two compartments and the detergent contains:

(a) 5–30 percent by weight of one or more solid acids which form water-soluble calcium and magnesium salts and/or complexes, at least one acid having a $pK_1$-value in the range of from 2.8 to 4.8;

(b) at least 5 percent by weight of alkali carbonate;

(c) usual detergent ingredients; the total amount of alkali being present in stoichiometric excess relative to the total amount of acid, the one or more solid acids being present in the one compartment and the one or more alkali substances being present in the other compartment, the contents of the compartment containing the acids being released in the gradually warming wash liquor at a rate such that the pH of the wash liquor is in the range of 2.0 to 5.0 before its temperature is 25° C., the other compartment entirely or partly consisting of a material which becomes permeable to or disintegrates in water at a temperature above room temperature, more particularly in the range of from 40° to 60° C., the contents of said other compartment dissolving practically entirely before the temperature of the wash liquor has reached a value of 60° C. and a pH is imparted to the liquid in the range of 9.0 to 10.5.

The feed unit may be characterized according to the invention in that it partly consists of a non-woven material.

Another embodiment of the feed unit according to the invention is characterized in that the compartment in which the alkaline substances are present partly consists of polymers or copolymers of methacrylic acid and/or methacrylic esters. The feed unit according to the invention is advantageously characterized in that the compartment containing the alkaline substances is provided with one or more seams which open at a temperature above room temperature, more particularly in the range of 40° to 60° C. According to the invention one or more seams of the sachet may entirely or partly be filled with a mixture of polyethylene glycol and one or more thermoplastic acrylic resins.

According to the invention the feed unit may be characterized in that the detergent contains a mixture of adipic, glutaric and succinic acid. Alternatively, the feed unit according to the invention may be characterized in that the detergent contains as surfactant an alkyl ether sulphate.

The invention also comprises a container in which a number of feed units according to the invention are packaged. Very satisfactory in actual practice appears to be a container in the form of a box in which the feed units are so packaged that the sealing edges thereof are bent by the walls of the box. Such a provision can be realized in a simple manner in that the distance between two opposite, parallel box walls is at least 5 to 15 mm smaller than the dimension transverse to the sealing edge of the feed units that are substantially in the form of flat sachets. In a practical experiment a number of cardboard boxes each containing 12 feed units or sachets of the type described in NL 7805293 were transported in a van over a large distance, with the temperature in the storage space increasing to 40° C. Part of the boxes were formed according to the invention and their inside width was 20 mm smaller than the width of the sachets measured in transverse direction of the two parallel sealing edges in the non-folded state. Of the sachets packaged in these boxes according to the invention the two opposite sealing edges were bent through an angle of about 90°. When at the end of their transport the boxes were opened, it was found that none of the sachets having bent sealing edges had opened, so that all sachets were still in perfect condition for further use and had not sustained any damage during transportation. Another part of the boxes were not in the form according to the invention and contained sachets that were not provided with external means of keeping the internally glued sealing edges closed.

Upon opening the boxes containing the sachets that were not in the form according to the invention, it was found that in each box there were a few sachets whose sealing edges were entirely or partly opened and that part of the alkaline detergent contents of the sachets had leaked into the box. So a considerable part of the sachets that were not in the form according to the invention were no longer suitable for use after they had been transported. In other words, if the edges of the sachets packaged in a box are not bent, a poor product is obtained.

From the above comparative example it is apparent that the sachet having folded edges according to the invention constitutes a considerable improvement. The problems of prematurely opening sachets during storage or transport has been solved in a very simple way by the proposal according to the invention. The proposal according to the invention makes it possible for the properties of the product to be better controlled. Notably, the invention makes it possible to realize that the sealing edge will open in the washing machine in the manner envisaged.

Another embodiment of the invention is characterized in that the container is provided with means of keeping the sealing edges of the feed units packages therein closed, more particularly means of folding said edges. More specifically, these means according to the invention may be formed on the inside walls of the box by U-shaped strips into which the folded sealing edge of a sachet may be slipped.

In the case where the feed unit according to the invention comprises two compartments it may be so constructed that the one compartment contains a detergent and the other compartment a softening agent.

Alternatively, according to the invention, one of the two compartments may contain a detergent and the other compartment a bleaching agent. When use is made of two compartments it is also possible for the one compartment to contain a bleaching agent and the other compartment to contain a softening agent. In the case where the feed unit according to the invention comprises three compartments, the first compartment may contain a detergent, the second compartment a bleaching agent and the third compartments a softening agent. Another three-compartment feed unit according to the invention is characterized in that the first compartment contains an acid fraction, the second compartment an alkaline fraction and the third compartment a softening agent.

It should be added that also NL 7805264 and U.S. Pat. No. 2,760,942 describe sachets for detergents which are released under the influence of the water in the washing machine.

The invention will be further described with reference to the accompanying schematic drawing.

Figure 1:
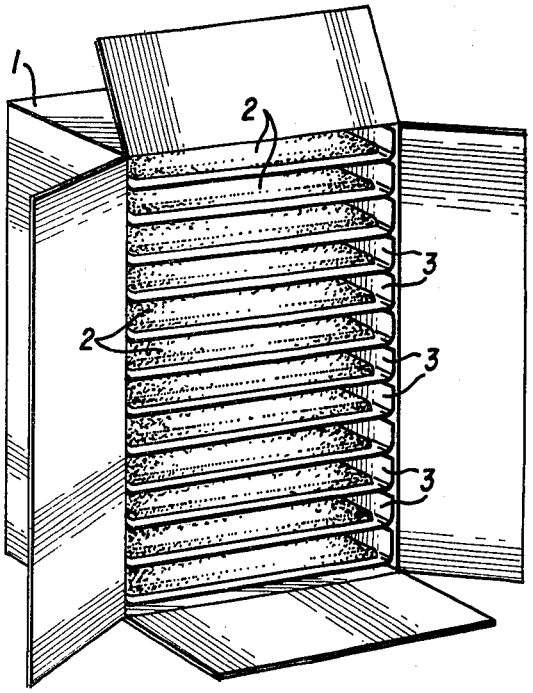
FIG. 1 shows a box containing sachets according to the invention.

FIG. 1 illustrates a box 1 with opened lid containing a dozen sachets 2 according to the invention. The distance between the two parallel box walls is so dimensioned that the sachets 2 can be inserted only with their sealing edges 3 folded. Although the sachets in the drawing are provided with two sealing edges, it is also possible to use an embodiment in which the sachet has more than two, for instance four sealing edges.

Figure 2:
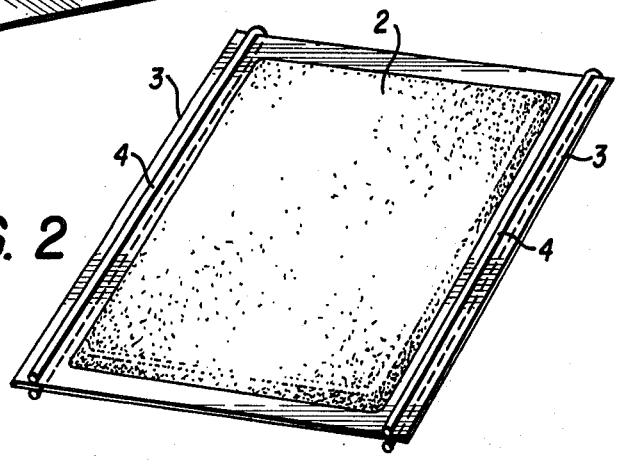
FIGS. 2 and 3 show sachets according to the invention, provided with special clips.

FIG. 2 shows one sachet 2 in perspective and provided with two sealing edges 3. The one sealing edge 3 is provided with a clip 4 whose two parallel legs exert such a pressure on the walls of the sachet that the sealing edges are kept securely closed and do not open prematurely. The construction of the clip 4 may vary; for instance it may be in the form of an elastic metal clip or be made of some elastic plastic material. Also the other sealing edge 3 is provided with such a clip 4.

Figure 3:
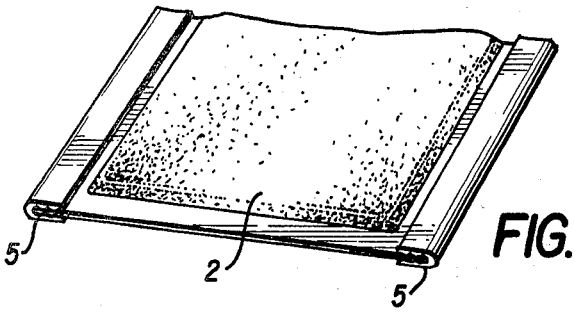

FIG. 3 illustrates another embodiment, in which only part of one sachet 2 according to the invention is given in perspective. The two parallel sealing edges of the sachet are each provided with a clamping strip 5 of some elastic material and having a substantially U-shaped cross-section viewed transverse to the longitudinal direction.

It should be added that various ways of folding the edge of a small bag or some other packaging means are known in themselves in other fields of application. as in packaging deep-freeze products, dehydrated soup ingredient, pipe tobacco and other products. For these packaging means reference is made to FR No. 1 239 445, BE No. 531 835, CH No. 401 812, FR No. 2 198 458, U.S. Pat. No. 4,142,346, U.S. Pat. No. 2,629,916, GB No. 1 443 995, U.S. Pat. No. 3,008,837 and U.S. Pat. No. 2,922,568.

Within the scope of the invention various modifications may be made.

We claim:

1. A container for detergent, preferably a box, having at least two parallel walls, characterized in that the box comprises a substantial number of stacked detergent feed units that are each in the form preferably of a substantially flat, rectangular sachet, having one or more compartments containing detergent constituents, at least one edge of a compartment being sealed with a glue or other adhesive, which edge opens after a while upon contact with water in a washing machine, said sachets being so packaged in the box that the sealing edges thereof are bent by said parallel walls of the box.

2. A container according to claim 1, characterized in that one compartment is provided with one or more special seals such that they open in water of a washing machine at a temperature above room temperature.

3. A container according to claim 1, characterized in that the special seal is so constructed and arranged that it opens in water of a washing machine at a temperature in the range of from 30° to 60° C.

4. A container according to claim 1, characterized in that the distance between two opposite parallel box walls is at least 5 to 15 mm smaller than the dimension transverse to the longitudinal direction of said special sealing edge of said flat sachets.

5. A container according to claim 3, characterized in that each sachet comprises at least two compartments, one compartment having a water-permeable, water-soluble or water-dispersible outer wall and containing acid, and another compartment containing an alkaline detergent based on alkali metal carbonate, at least one edge of the compartment containing said alkaline detergent forming a sealing edge which is sealed with a glue or other adhesive, and which is so temperature-sensitive that this compartment opens at a temperature in the range of from 30° to 60° C.

* * * * *